United States Patent [19]

Bares

[11] Patent Number: 4,926,217

[45] Date of Patent: May 15, 1990

[54] PARTICLE TRANSPORT

[75] Inventor: Jan Bares, Webster, N.Y.

[73] Assignee: Xerox Corporation, Stamford, Conn.

[21] Appl. No.: 895,543

[22] Filed: Aug. 11, 1986

[51] Int. Cl.[5] ..... G03G 15/08

[52] U.S. Cl. ..... 355/253; 406/86; 366/101

[58] Field of Search ..... 355/300, 15, 245, 253, 355/260; 118/653, 654, 652; 222/DIG. 1; 406/86, 55, 138, 191; 366/101, 102, 110, 114

[56] References Cited

U.S. PATENT DOCUMENTS

| | | | |
|---|---|---|---|
| 2,872,338 | 2/1959 | Landrigan et al. | 118/654 X |
| 3,103,445 | 9/1963 | Bogdonoff et al. | 117/17.5 |
| 3,185,777 | 5/1965 | Rheinfrank . | |
| 3,357,402 | 12/1967 | Bhagat . | |
| 3,659,556 | 5/1972 | Matschler | 118/637 |
| 3,951,539 | 4/1976 | Draugelis | 355/300 |
| 4,030,447 | 6/1977 | Takahashi et al. | 118/658 |
| 4,093,369 | 6/1978 | Hewitt | 355/15 |
| 4,142,655 | 3/1979 | Fantuzzo | 222/318 |
| 4,173,405 | 11/1979 | Swapceinski et al. | 355/3 |
| 4,185,783 | 1/1980 | Lacchia | 406/86 X |
| 4,230,069 | 10/1980 | Aldea et al. | 118/653 |
| 4,266,868 | 5/1981 | Bresina et al. | 355/3 |
| 4,360,944 | 11/1982 | Iwai et al. . | |
| 4,442,789 | 4/1984 | Pirwitz | 118/653 |
| 4,586,460 | 5/1986 | Kohyama et al. | 118/653 |
| 4,650,312 | 3/1987 | Vineski | 355/15 |
| 4,743,936 | 5/1988 | Bares | 355/253 |

FOREIGN PATENT DOCUMENTS

| | | | |
|---|---|---|---|
| 2509831 | 9/1975 | Fed. Rep. of Germany | 355/300 |
| 3000386A1 | 7/1981 | Fed. Rep. of Germany . | |
| 3427705 | 1/1986 | Fed. Rep. of Germany | 406/191 |
| 53-78846 | 7/1978 | Japan . | |
| 53-141667 | 9/1982 | Japan . | |
| 58-4467 | 3/1983 | Japan . | |
| 59-67563 | 4/1984 | Japan . | |
| 59-95556 | 6/1984 | Japan . | |
| 60-233674 | 11/1985 | Japan | 355/300 |
| 1601854 | 11/1981 | United Kingdom . | |

OTHER PUBLICATIONS

*IBM Technical Disclosure Bulletin,* vol. 22, No. 5, Oct. 1979, Berg, "Replacing a Toner Return Auger System by an Ejector" p. 1937.

*Research Disclosure,* Sep. 1977, No. 161, McGlen et al, "A Toning Station Using Counter Rotating Magnetic Rollers", No. 16126.

*Primary Examiner*—Joan H. Pendegrass

*Attorney, Agent, or Firm*—H. Fleischer; J. E. Beck; R. Zibelli

[57] ABSTRACT

An apparatus in which particles are moved from one end of a duct to the other end thereof. The particles in the duct are fluidized. A pressure differential is generated which moves the fluidized particles in the duct from one end of the duct to the other end thereof.

2 Claims, 3 Drawing Sheets

PARTICLE TRANSPORT

This invention relates generally to an electrophotographic printing machine, and more particularly concerns a development apparatus wherein particles are transported thereto from a remote location.

In an electrophotographic printing machine, a photoconductive member is charged to substantially uniformed potential to sensitize the surface thereof. The charged portion of the photoconductive member is exposed to a light image of an original document being reproduced. Exposure of the charged photoconductive member selectively dissipates the charge thereon in the irradiated areas. This records an electrostatic latent image on the photoconductive member corresponding to the informational areas contained within the original document being reproduced. After the electrostatic latent image is recorded on the photoconductive member, the latent image is developed by bringing a developer material into contact therewith. This forms a powder image on the photoconductive member which is subsequently transferred to a copy sheet. The copy sheet is heated to permanently affix the marking particles thereto in image configuration.

In the foregoing type of printing machine, a development system is employed to deposit developer material onto the electrostatic latent image recorded on the photoconductive surface. Generally, the developer material comprises toner particles adhering triboelectrically to coarser carrier granules. Typically, the toner particles are made from a thermoplastic material while the carrier granules are made from a ferromagnetic material. Alternatively, a single component magnetic material may be employed. A system utilizing a single component magnetic developer material is capable of high speeds. Thus, a single component developer system readily lends itself to applications involving high speed electrophotographic printing machines. However, a large continuous supply of toner particles must be available to be capable of copying large numbers of original documents or producing multiple copies of the same original document. This is necessary in order to insure that the machine is not shut down at relatively short intervals due to the lack of toner particles. Ideally, this is achieved by utilizing a remote toner sump, a toner sump containing a large supply of toner particles positioned remotely from the developer housing in the printing machine. The toner particles are then transported from the toner sump to the development system. However, it has been found that it is frequently difficult to locate the toner sump within the printing machine while still optimizing the printing machine architecture. This is due to the fact that the toner particles do not readily move against the gravitational force. Hence, the toner sump must be positioned above the development system. Under these circumstances, this restricts the machine architecture. Moreover, it is necessary not only to be capable of transporting magnetic particles but non-magnetic toner particles as well. Frequently, it is highly desirable to be capable of developing the latent image with insulating, non-magnetic toner particles. Insulating toner particles optimize copy quality. However, the problem of transporting these toner particles from a remote location must be overcome. The following disclosures appear to be relevant:

U.S. Pat. No. 3,103,445, Patentee: Bogdonoff et al., Issued: Sept. 10, 1963.

U.S. Pat. No. 3,659,556, Patentee: Mustschler, Issued: May 2, 1972.

U.S. Pat. No. 4,030,447, Patentee: Takahashi et al., Issued: June 21, 1977.

U.S. Pat. No. 4,093,369, Patentee: Hewitt, Issued: June 6, 1978.

U.S. Pat. No. 4,142,655, Patentee: Fantuzzo, Issued: Mar. 6, 1979.

U.S. Pat. No. 4,173,405, Patentee: Swapceinski et al., Issued: Nov. 6, 1979.

U.S. Pat. No. 4,230,069, Patentee: Aldea et al., Issued: Oct. 28, 1980.

U.S. Pat. No. 4,266,868, Patentee: Bresina et al., Issued: May 12, 1981.

Japanese Patent Publication No. 53-78846, Applicant: Hasebe, Published: July 12, 1978.

Japanese Patent Publication No. 57-141667, Applicant: Itou, Published Sept. 2, 1982.

Japanese Patent Publication No. 58-4467, Applicant: Nakahata, Published: Mar. 15, 1983.

Japanese Patent Publication No. 59-67563, Applicant: Kodowaki, Published: Apr. 17, 1984.

Japanese Patent Publication No. 59-95556, Applicant: Yano, Published: June 1, 1984.

The relevant portions of the foregoing disclosures may be briefly summarized as follows:

Bogdonoff describes an auger for advancing developer material to a developing bin for use by a developing brush.

Mutschler discloses an auger for furnishing developer material to a developing brush.

Takahashi et al. describes a magnetic roll developer wherein a pair of screws convey and stir developer. One screw supplies fresh developer to the developing compartment and the other screw mixes the fresh toner with the old toner and distributes the replenished developer to the developing rolls.

Hewitt discloses a cleaning system wherein particles removed from a photoconductive surface pass through a conduit so as to be collected in a receptacle. The conduit is coupled to a blower which creates a pressure gradient so as to cause the particles to move from the cleaning system to the receptacle. A portion of the conduit is made from an impervious material. The pressure gradient causes air to flow through the air pervious portion of the conduit dislodging particles adhering to the wall of the conduit and fluidizing particles facilitating their flow to the receptacle.

Fantuzzo describes a toner dispenser in which toner is supplied to the developing station from a remote sump by a flexible auger. Excess toner is returned to the remote sump by a second auger.

Swapceinski et al. discloses an auger for transporting developer material to a magnetic brush from a remote sump. The developer material is advanced by the auger through a tube having holes therein. The developer material is distributed through the holes with excess developer material being returned to the remote sump by a second auger.

Aldea describes a particle feeder employing one screw for conveying pigmented particles to the vicinity of a drum and another screw for returning excess particles to the supply thereof.

Bresina et al. discloses an auger for supplying toner particles to a magnetic brush developer from an exterior container.

Hasebe describes a conveyor coil for advancing a developer mixture to a developer roll.

Itou discloses feed and return screws for continuously furnishing toner to a developer roller.

Nakahata shows augers for advancing developer material.

Kadowaki shows an auger for moving the developer material.

Yano shows a screw for advancing developer material.

Pursuant to the features of the present invention, there is provided an apparatus for moving particles from one end of a duct to the other end thereof. Means are provided for fluidizing the particles in the duct. Means generate a pressure differential to move the fluidized particles in the duct from one end thereof to the other end thereof.

In accordance with another aspect of the present invention, there is provided an apparatus for developing a latent image recorded on an image receiving member. The apparatus includes means for storing a supply of marking particles. Means transport marking particles into contact with the latent image recorded on the image receiving member. Means fluidize the marking particles and move the marking particles from the storing means to the transporting means.

Still another aspect of the present invention provides an electrophotographic printing machine of the type having an electrostatic latent image recorded on a photoconductive member. The improvement in the printing machine includes means for storing a supply of marking particles. Means transport the marking particles into contact with the latent image recorded on the image receiving member. Means fluidize the marking particles and move the marking particles from the storing means to the transporting means.

Other aspects of the present invention will become apparent as the following description proceeds and upon reference to the drawings, in which.

While the present invention will hereinafter be described in connection with various embodiments thereof, it will be understood that it is not intended to limit the invention to these embodiments. On the contrary, it is intended to cover all alternatives, modifications and equivalents that may be included within the spirit and scope of the invention as defined by the appended claims.

Figure 1:
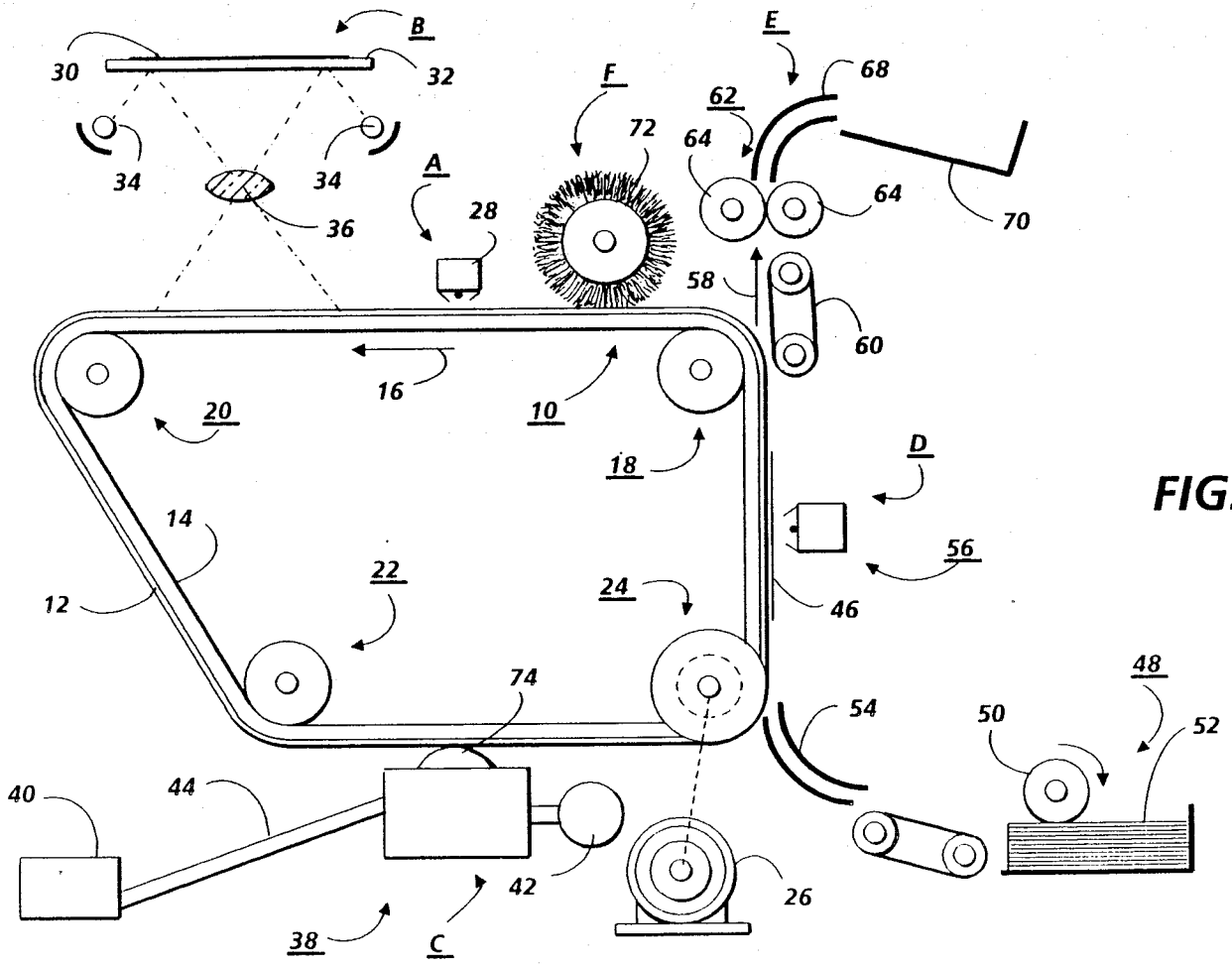
FIG. 1 is a schematic elevational view depicting an electrophotographic printing machine incorporating the development apparatus of the present invention therein.

For a general understanding of the features of the present invention, reference is made to the drawings. In the drawings, like reference numerals have been used throughout to designate identical elements. FIG. 1 schematically depicts the various elements of an illustrative electrophotographic printing machine incorporating the development system and particle transport of the present invention therein. It will become evident from the the following discussion that this apparatus is equally well suited for use in a wide variety of electrostatographic printing machines and other types of devices wherein granular particles are transported from an entrance port to a discharge region and is not necessarily limited in its application to the particular embodiment depicted herein.

Inasmuch as the art of electrophotographic printing is well known, the various processing stations employed in the FIG. 1 printing machine will be shown hereinafter schematically and their operation described briefly with reference thereto.

Turning now to FIG. 1, the electrophotographic printing machine employs a belt 10 having a photoconductive surface 12 deposited on a conductive substrate 14. Preferably, photoconductive surface 12 is made from a selenium alloy with conductive substrate 14 being made from an aluminum alloy which is electrically grounded. Other suitable photoconductive surfaces and conductive substrates may also be employed. Belt 10 moves in the direction of arrow 16 to advance successive portions of photoconductive surface 12 through the various processing stations disposed about the path of movement thereof. As shown, belt 10 is entrained about rollers 18, 20, 22 and 24. Roller 24 is coupled to motor 26 which drives roller 24 so as to advance belt 10 in the direction of arrow 16. Rollers 18, 20, and 22 are idler rollers which rotate freely as belt 10 moves in the direction of arrow 16.

Initially, a portion of belt 10 passes through charging station A. At charging station A, a corona generating device, indicated generally by the reference numeral 28, charges a portion of photoconductive surface 12 of belt 10 to a relatively high, substantially uniform potential.

Next, the charge portion of photoconductive surface 12 is advanced through exposure station B. At exposure station B, an original document 30 is positioned face down upon a transparent platen 32. Lamps 34 flash light rays onto original document 30. The light rays reflected from original document 30 are transmitted through lens 36 forming a light image thereof. Lens 36 focuses the light image onto the charged portion of photoconductive surface 12 to selectively dissipate the charge thereon. This records an electrostatic latent image on photoconductive surface 12 which corresponds to the informational areas contained within original document 30 disposed upon transparent platen 32. Thereafter, belt 10 advances the electrostatic latent image recorded on photoconductive surface 12 to development station C.

At development station C, a magnetic brush development system, indicated generally by the reference numeral 38, transports a single component developer material comprising toner particles into contact with the electrostatic latent image recorded on photoconductive surface 12. Toner particles are furnished to development system 38 from a remote toner container 40. Blower 40 maintains the pressure in the housing of development system 38 at a lower pressure than the pressure in remote toner container 40. Particle transport 44 couples remote toner container 40 to the housing of development unit 38 and remote toner container 40 causes toner particles to be advanced by particle transport 44 from remote container 40 to the housing of developer unit 38. The detailed structure of developer unit 38 will be described hereinafter with reference to FIG. 2. The detailed structure of particle transport 44 will be described hereinafter with reference to FIGS. 3, and 4(*a*) through 4(*d*), inclusive. Developer unit 38 forms a brush of toner particles which is advanced into contact with the electrostatic latent image recorded on photoconductive surface 12 of belt 10. Toner particles are attracted to the electrostatic latent image forming a toner powder image on photoconductive surface 12 of belt 10 so as to develop the electrostatic latent image.

After development, belt 10 advances the toner powder image to transfer station D. At transfer station D, a sheet of support material 46 is moved into contact with the toner powder image. Support material 46 is advanced to transfer station D by a sheet feeding apparatus, indicated generally by the reference numeral 48. Preferably, sheet feeding apparatus 48 includes a feed roll 50 contacting the upper most sheet of a stack of sheets 52. Feed roll 50 rotates to advance the upper most sheet from stack 50 into chute 54. Chute 54 directs the advancing sheet of support material 46 into contact with photoconductive surface 12 of belt 10 in a timed sequence so that the toner powder image developed thereon contacts the advancing sheet of support material at transfer station D.

Transfer station D includes a corona generating device 56 which sprays ions onto the backside of sheet 46. This attracts the toner powder image from photoconductive surface 12 to sheet 46. After transfer, the sheet continues to move in the direction of arrow 58 onto a conveyor 60 which moves the sheet to fusing station E.

Fusing station E includes a fuser assembly, indicated generally by the reference numeral 62, which permanently affixes the powder image to sheet 46. Preferably, fuser assembly 62 includes a heated fuser roller 64 and a back-up roller 66. Sheet 46 passes between fuser roller 64 and backup roller 66 with the toner powder image contacting fuser roller 64. In this manner, the toner powder image is permanently affixed to sheet 46. After fusing, chute 66 guides the advancing sheet to catch tray 68 for subsequent removal from the printing machine by the operator.

Invariably, after the sheet of support material is separated from photoconductive surface 12 of belt 10, some residual particles remain adhering thereto. These residual particles are removed from photoconductive surface 12 at cleaning station F. Cleaning station F includes a pre-clean corona generating device (not shown) and a rotatably mounted fibrous brush 72 in contact with photoconductive surface 12. The pre-clean corona generator neutralizes the charge attracting the particles to the photoconductive surface. These particles are cleaned from the photoconductive surface by the rotation of brush 72 in contact therewith. Subsequent to cleaning, a discharge lamp (not shown) floods photoconductive surface 12 with light to dissipate any residual charge remaining thereon prior to the charging thereof for the next successive imaging cycle.

It is believed that the foregoing description is sufficient for purposes of the present application to illustrate the general operation of an exemplary electrophotographic printing machine incorporating the features of the present invention therein.

Figure 2:
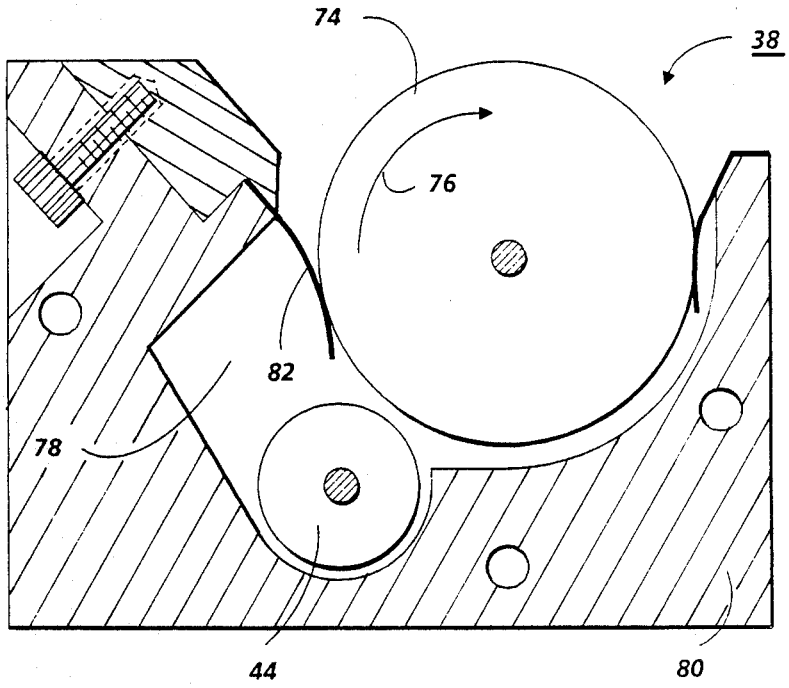
FIG. 2 is a schematic elevational view showing the development apparatus used in FIG. 1 printing machine.

Referring now to FIG. 2, the detailed structure of developer unit 38 is shown thereat. The developer unit include a donor roller 74. Donor roller 74 may be a bare metal such as aluminum. Alternatively, the donor roller may be a metal roller coated with a thick material. By way of example, a polytetrafluoroethylene based resin such as Teflon, a trademark of the DuPont Corporation, or a polyvinylidene fluoride based resin, such as Kynar, a trademark of the Pennwalt Corporation, may be used to coat the metal roller. This coating acts to assist in charging the particles adhering to the surface thereof. Still another type of donor roller may be made from stainless steel plated by a catalytic nickel generation process and impregnated with Teflon. The surface of the donor roller is roughened from a fraction of a micron to several microns, peak to peak. An electrical bias is applied to the donor roller of about 600 volts for coatings up to 0.5 millimeters thick. Donor roller 74 is coupled to a motor which rotates donor roller 74 in the direction of arrow 76. Donor roller 74 is positioned, at least partially, in chamber 78 of housing 80. Particle transport 44 has the exit portion thereof in chamber 78 of housing 80 so as to advance toner particles thereto. In this way, housing 78 containing a continuous supply of toner particles which are received by donor 74 and advanced, in the direction of arrow 76, into contact with the electrostatic latent image recorded on photoconductive surface 12 of belt 10. As donor roller 74 rotates in the direction of arrow 76, charging blade 82 has the region of the free end thereof resiliently urged into contact with donor roller 74. Charging blade 82 may be made from a metal, Silicone rubber, or a plastic material. By way of example, charging blade 82 may be made from steel phosphor bronze and ranges from about 0.025 millimeters to about 0.25 millimeters in thickness, being a maximum of 25 millimeters wide. The free end of the charging blade extends beyond the tangential contact point with donor roller 74 by about 4 millimeters or less. Charging blade 82 is maintained in contact with donor roller 74 at a pressure ranging from about 10 grams per centimeter to about 250 grams per centimeter. The toner particle layer adhering to donor roller 74 is charged to a maximum of 60 microcoulombs with the toner mass adhering thereto ranging from about 0.1 milligrams per centimeter$^2$ to about 2 milligrams per centimeter$^2$ of roll surface. It is thus seen that transport 44 continually furnishes toner particles to chamber 78 of housing 80 so that donor roller 74 transports these toner particles in the direction of arrow 76. The toner particles adhering to donor roller 74 are charged by charging blade 82 prior to advancing into contact with the electrostatic latent image recorded on photoconductive surface 12. These toner particles are attracted to the electrostatic latent image to form a toner powder image on photoconductive surface 12 of belt 10. The detailed structure of particle transport 44 will be described hereinafter with reference to FIGS. 3 and 4A through D, inclusive.

Figure 3:
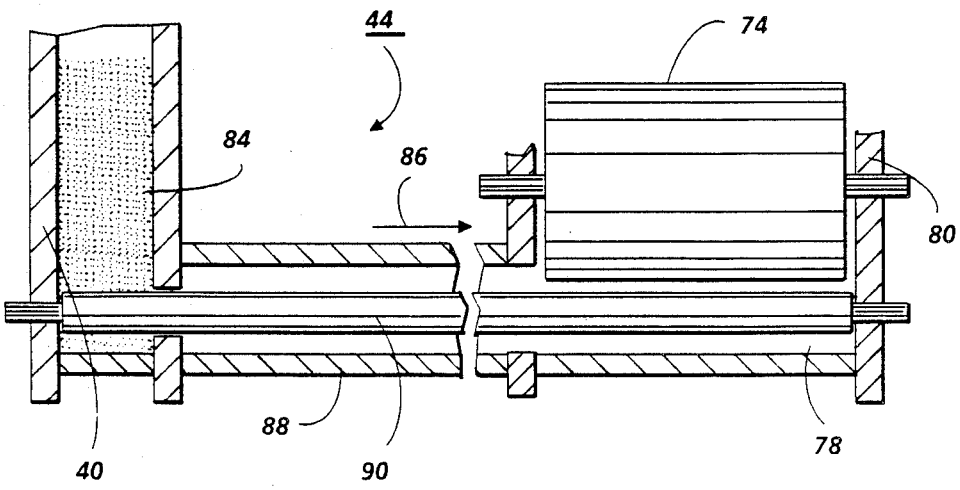
FIG. 3 is a fragmentary, sectional elevational view depicting the transport moving the particles from the remote toner container to the FIG. 2 development apparatus.

Turning now to FIG. 3, there is shown particle transport 44 in greater detail. As depicted thereat, particle transport 44 connects remote toner container to chamber 78 of housing 80 of developer unit 38. Toner particles stored in chamber 84 of remote container 40 are advanced by particle transport 44 in the direction of arrow 86 to chamber 78 of housing 80. Blower 42 (FIG. 1) coupled to chamber 78 of housing 80 maintains chamber 78 at a lower pressure than chamber 84 of remote container 40. Particle transport 44 includes an elongated duct 88, preferably tubular in shape, which has an entrance region in chamber 84 and an exit region in chamber 78. An elongated member 90 is mounted interiorly of duct 88. Elongated member 90 rotates and fluidizes the toner particles in duct 88. Elongated member 90 is adapted only to fluidize and agitate the particles, it imparts substantially no longitudinal movement thereto. Rather than rotating, elongated member 90 may vibrate to agitate and fluidize the particles. The fluidized toner particle be that is the agitated toner particles move in the direction of arrow 86 due to the pressure differential between chamber 78 and chamber 84. One skilled in the art will appreciate that gravity may be used to move the fluidized particles as long as the the toner level in chamber 78 is lower than that of chamber 84. In this way, the fluidized and agitated toner particles move from the entrance region of duct 88 in chamber 84 of remote container 40 to the exit region thereof in chamber 78 of housing 80. Thus, a continuous supply of toner particles is furnished from remote container 40 to housing 80 of developer unit 38. Elongated member 90 extends under or along roller 74 to facilitate the deposition of toner particles on roller 74 by agitation of the bed of toner particles in chamber 78, and thereby bringing the toner particles into contact with roller 74. The detailed structure of elongated member 90 will be described hereinafter with reference to FIGS. 4(*a*) through 4(*d*), inclusive.

Figure 4:
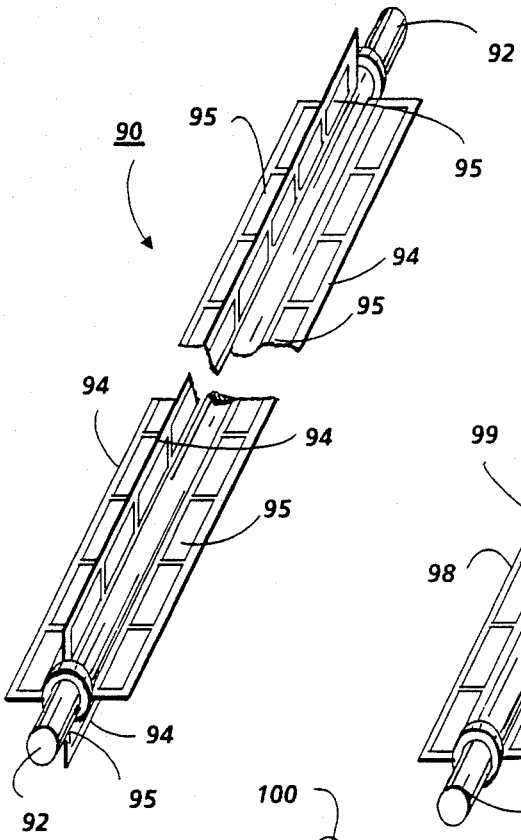
FIGS. 4(*a*) through 4(*d*) inclusive show perspective views of various types of assemblies used in the FIG. 3 transport for fluidizing the toner particles therein.
Figure 4:
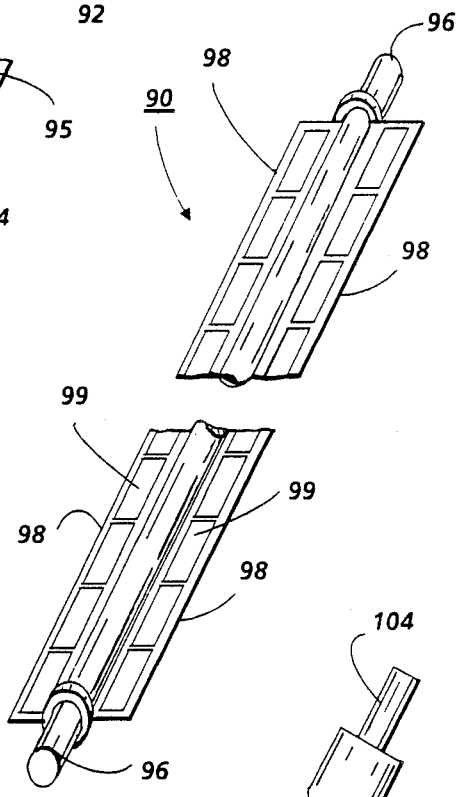
Figure 4:
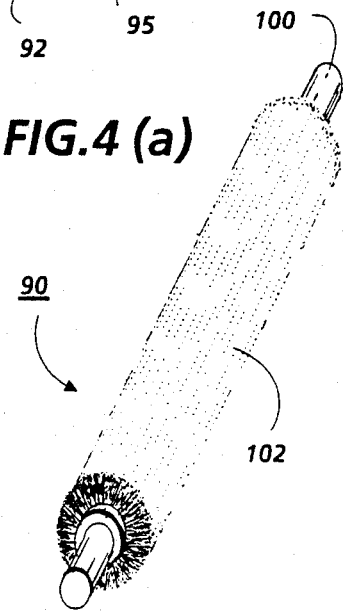
Figure 4:
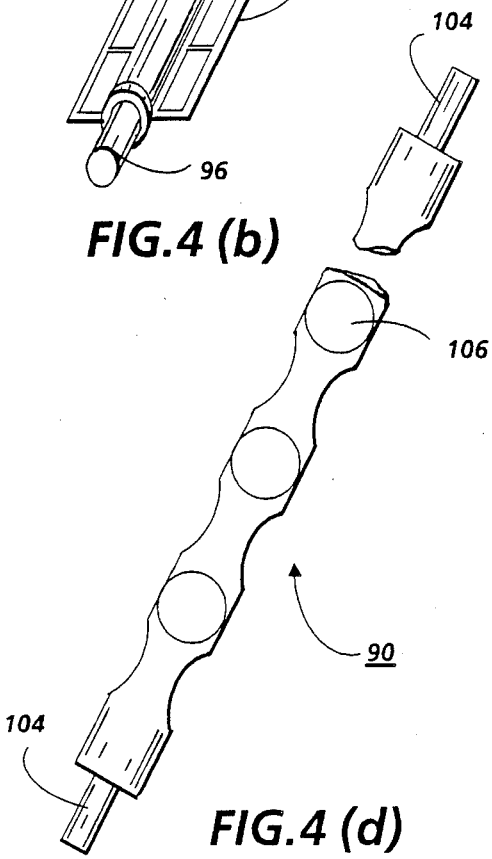

FIGS. 4(*a*) through 4(*d*), inclusive show various embodiments of elongated member 90. Referring initially to FIG. 4(*a*), there is shown one embodiment of elongated member 90. As depicted thereat, elongated member 90 includes a rod 92 having a plurality of equally spaced rectangularly shaped paddles 94 extending outwardly therefrom. Each paddle is spaced from the next adjacent paddle by about 90°. The paddles have a plurality of substantially equally spaced rectangular openings 95 therein. As elongated member 90 rotates, the paddles agitate and fluidize the toner particles duct 88. This permits the toner particles to advance along duct 88, in the direction of arrow 86, due to the pressure differential and not adhere to the walls thereof.

Turning now to FIG. 4(*b*), there is shown another embodiment of an elongated member 90. As depicted thereat, elongated member 90 includes a rod 96 having two paddles 98 extending outwardly therefrom. The paddles are spaced about 180° from one another. Each paddle has a plurality of substantially equally spaced rectangular openings 99 therein. Once again, as rod 96 rotates, paddles 98 fluidize and agitate the toner particles facilitating the movement thereof due to the pressure gradient in the direction of arrow 86 along duct 88.

FIG. 4(C) shows another embodiment of elongated member 90. As illustrated in FIG. 4(*c*), elongated member 90 includes a rod 100 having a multiplicity of fibers or bristles 102 extending outwardly therefrom. As rod 100 rotates, bristles 102 fluidize and agitate the toner particles in duct 88 to facilitate there movement thereof, due to the pressure differential, in the direction of arrow 86 from chamber 84 of remote container 40 to chamber 78 of housing 80.

The final embodiment of elongated member 90 is shown in 4(*d*). As depicted, elongated member 90 includes a hollow rod or tube 104 having four equally spaced rows of apertures or holes 106 therein. Each row of holes is spaced about the periphery of rod 104 by about 90°. Eaoh hole in each row is spaced from the next adjacent hole. The holes are equally spaced from one another. In this way, as tube 104 rotates, holes 106 therein cause the toner particles in duct 88 to be agitated and fluidized so as to facilitate their movement, in the direction of arrow 86, therealong due to the pressure differential.

One skilled in the art will appreciate that while the particle transport of the present invention has been illustrated as advancing toner particles from a remote toner container to a developer unit, this particle transport may be employed to move granular particles from an entrance region to an exit region irrespective of the type of device that it is employed in. For example, in an electrophotographic printing machine, the particle transport may also be used to transport residual particles from the cleaning housing to a remote container for subsequent removal from the printing machine.

A particle transport of the type depicted in the present invention enables the particles to be moved from any remote location to any other location. As depicted herein, the developer unit is positioned in a six o'clock orientation with respect to the photoconductive surface. Thus, the photoconductive surface is above the developer unit with respect to the gravitational forces. The particle transport moves the toner particles in upwardly direction against the force of gravity. Thus, the location of the remote toner container is no longer a constraint on the machine architecture.

In recapitulation, it is clear that the particle transport of the present invention includes a duct having an entrance and exit portion therein. The duct has an elongated member disposed interiorly thereof for fluidizing and agitating toner particles received in the entrance region. A pressure differential is maintained between the exit region and the entrance region of the duct. This pressure differential moves the fluidized toner particles along the duct from the entrance region to the exit region thereof independent of the orientation of the duct with respect to gravitational forces.

It is, therefore, evident that there has been provided, in accordance with the present invention a particle transport that fully satisfies the aims and advantages hereinbefore set forth. While this invention has been described in conjunction with various embodiments thereof, it is evident that many alternatives, modifications and variations will be apparent to those skilled in the art. Accordingly, it is intended to embrace all such alternatives, modifications and variations as fall within the spirit and scope of the appended claims.

I claim:

1. An apparatus arranged for use in an electrophotographic printing machine for moving marking particles from a storage container located at one end of a tube to a developer unit located at the other end thereof, including:

an elongated member disposed interiorly of said tube, said elongated member includes a rod having a multiplicity of fibers extending outwardly therefrom;

means for moving said elongated member to fluidize the particles in the tube without inducing any substantial linear movement of the particles along the tube; and means for generating a pressure differential to move the fluidized particles in the tube from the storage container located at one end of the tube to the developer unit located at the other end of the tube.

2. An apparatus arranged for use in an electrophotographic printing machine for moving marking particles from a storage container located at one end of a tube to a developer unit located at the other end thereof, including:

an elongated member disposed interiorly of said tube, said elongated member includes a hollow rod having a plurality of apertures therein with said apertures being arranged in a plurality of rows, means for moving said elongated member to fluidize the particles in the tube without inducing any substantial linear movement of the particles along the tube; and means for generating a pressure differential to move the fluidized particles in the tube from the storage container located at one end of the tube to the developer unit located at the other end of the tube.

* * * * *